US006491301B1

(12) United States Patent
Webb

(10) Patent No.: US 6,491,301 B1
(45) **Date of Patent: *Dec. 10, 2002**

(54) METHOD AND APPARATUS FOR PLAYING A CARD GAME INCLUDING A VARIABLE PAYOFF

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/845,333

(22) Filed: May 1, 2001

Related U.S. Application Data

(63) Continuation-in-part of application No. 09/336,760, filed on Jun. 21, 1999, now Pat. No. 6,296,251.

(51) Int. Cl.[7] ..... A63F 1/00
(52) U.S. Cl. ..... 273/274; 273/292; 463/12
(58) Field of Search ..... 273/292, 303, 273/274; 463/12, 13

(56) References Cited

U.S. PATENT DOCUMENTS 5,566,946 A 10/1996 Parker
5,673,917 A 10/1997 Vancura
6,296,251 B1 * 10/2001 Webb ..... 273/274

OTHER PUBLICATIONS

Scarne, John, Scarne's Encyclopedia of Games, Chapter 16, Harper & Row, Publishers, 1973, pp. 276–286.

* cited by examiner

*Primary Examiner*—Benjamin H. Layno
*Assistant Examiner*—V K Mendiratta
(74) *Attorney, Agent, or Firm*—Nixon & Vanderhye P.C.

(57) ABSTRACT

A payout scheme for a card game is based on a numerical difference between a player's hand and a dealer's hand. The method is suited for card games wherein the numerical value of a player's hand affects the outcome of the game. Preferably, the game is a Blackjack derivative, wherein the payout based on the original wager is determined in accordance with an amount by which the player's hand exceeds the dealer's hand, without exceeding an upper limit. Alternatively, the game may be based on a modified numerical value system where aces count as 1, cards numbered 2–9 count as face value, cards numbered 10 count as either ½ or 0, and picture cards count as ½.

17 Claims, 2 Drawing Sheets

METHOD AND APPARATUS FOR PLAYING A CARD GAME INCLUDING A VARIABLE PAYOFF

CROSS-REFERENCES TO RELATED APPLICATIONS

This application is a continuation-in-part (CIP) of U.S. patent application Ser. No. 09/336,760, filed Jun. 21, 1999, now U.S. Pat. No. 6,296,251 B1 the entire contents of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to card games and, more particularly, to a variable payoff scenario for a casino card game wherein the game outcome is determined based on a numerical total of a player's hand.

With the expansion of gaming and the increase in competition, casinos are striving to offer a wider variety of games. Growth in slot machine popularity and the increase in variety of specialty games has resulted in the overall reduction in conventional games, such as Blackjack ("21") tables.

Many casinos, however, are reluctant to reduce the number of conventional tables because of the inherent game attractiveness to both players and casinos. For example, in Blackjack, the game is based on simple concepts and procedures that are readily understood by both casual and regular players. Moreover, the game requires relatively low overhead to facilitate and monitor. In addition, floor space is limited in a casino, and casino operators are reluctant to replace an income-generating Blackjack or other game table with a new game variety.

In conventional Blackjack, however, experienced players can utilize established strategies to practically eliminate the house advantage. The ability to eliminate the house advantage is obviously a concern for casino operators. Additionally, less experienced or beginning players may be hesitant to play Blackjack because they are aware that such strategies exist, but are unable to execute them themselves. Novice players play poorly even with some knowledge of the basic strategy and therefore have a more negative experience than might otherwise have been the case. Still further, with conventional Blackjack, these established strategies can be enhanced to actually achieve a player advantage when coupled with the use of card counting. Although discouraged in most casinos, it is difficult to police card counting as a rehearsed card counter can typically count cards without exhibiting any outward appearance of counting.

Still further, disputes between the players can arise when novice players are seated with experienced players. That is, a novice player may instruct the dealer to deal an additional card or instruct the dealer not to deal an additional card when the experienced player believes the contrary was appropriate. Often, the experienced player perceives that the novice's improper instruction resulted in an adverse outcome.

In an attempt to accommodate the desire for variety and the retention of a significant Blackjack presence, several Blackjack variant games have been introduced. These games include Multiple Action Blackjack, Spanish 21, Face-Up 21, and Royal Match. See, e.g., U.S. Pat. No. 5,673,917 to Vancura. A summary of known Blackjack variants is discussed in the Vancura patent. Spanish 21, however, seems to be the only Blackjack variant that has endeavored to address the primary problems of Blackjack. In Spanish 21, the cards with a value of 10 are removed from the regular deck. As the 10 cards are valuable for a card counter, Spanish 21 is less attractive to the card counter. The removal of 10's alone increases the house advantage too high, so additional play options and bonus pays are incorporated to give a better balanced house advantage. However, there is still a best basic strategy for Spanish 21, which the majority of players are probably unaware is quite different from regular basic strategy. Thus, while the game is an enjoyable variant and has achieved some popularity, many players will have had a substantively more negative experience than at regular Blackjack.

BRIEF SUMMARY OF THE INVENTION

It is thus an object of the invention to provide a method and apparatus for playing a card game that overcomes the drawbacks associated with conventional casino games such as Blackjack. It is another object of the invention to provide a card game incorporating a variable payoff based on the difference between a player hand numerical total and a dealer hand numerical total.

According to the invention, a casino game is provided that can be played on existing or slightly modified game tables. In an exemplary embodiment, the game according to the invention is a Blackjack derivative, wherein the payoff for a winning hand is variable based on a difference between player and dealer hands. There is no such variable payoff in conventional Blackjack, with the exception of a 3 to 2 payoff for a two-card total of 21, but that payoff only comes up when a player is dealt a hand totaling 21 (when the dealer is not dealt a matching hand), and the payoff is not related to any difference between hands.

According to the invention, when the dealer busts, the player preferably receives only a push on his wager (in order to control the house advantage, which is markedly changed with a variable payoff variant). When the dealer and player have equal hands, the game is a draw and the wager is also pushed. When the player beats the dealer, and the dealer's hand has not exceeded an upper limit, the payoff is variable.

The introduction of a variable payoff scale has a dramatic impact on best basic player strategy. As the player only pushes when the dealer busts according to the invention, there is an incentive for the player to hit hands with a total of 12 through 16. This contrasts with Blackjack where standing or hitting such hands is influenced by reference to the dealer's up card (one of the two dealer cards that is visible to the player). Moreover, because of the variable payoff scale, a higher hand has more value, compounding the attraction of not standing on 12 through 16. Soft totals (e.g., hands with an Ace that can be treated as a value of 1 or 11) would also be hit more frequently for the same reasons.

By creating a payoff scale that justifies a somewhat similar strategy of play, regardless of dealer up card, the game according to the invention is simple to learn. It is the player's goal to achieve a total of 18–21 to win, as according to a preferred embodiment, a total of 17 can only tie or push. With the simpler strategy according to the invention, the conventional Blackjack skill elements are reduced, and the casino has less need to be concerned about card counters. Moreover, new players and novice players have an easier learning curve along with a common desire to achieve a maximum hand total.

The house advantage can be varied by altering the payoff scale in the rules of play. Players typically better enjoy such a game with liberal options such as splitting pairs, no limits on re-splitting pairs, doubling any hand (including splits and soft totals), hitting after doubling, doubling after doubling, additional bonuses for specific hands (such as blackjack, pairs), etc. Still further, the game according to the invention can be played with alternative dealer standing rules, contrary to conventional Blackjack where the dealer must stand with 17 (except soft 17 at some casinos). If a dealer stands with 18, then the payoff scale could be raised, whereas if the dealer stands with 16, the payoff scale can be reduced.

The application of a payoff scale to an even money game therefore changes the whole dynamics of the game. Other casino games that rely on numerical values such as Baccarat or War can easily be adapted according to the invention with the introduction of the payoff scale, with payoffs depending upon the amount by which a hand is won. As with Blackjack, the exact rules of play for the game variant should be changed to most easily accommodate the payoff scale introduction.

In a variant operating mode, a Blackjack-style game has a modified numerical value system. In the modified numerical value system, an ace counts as 1, cards numbered 2–9 count as face value, and cards numbered 10 and picture cards count as ½. Alternatively, aces count as 1, cards numbered 2–9 count as face value, cards numbered 10 count as 0, and picture cards count as ½. In either numerical value system, a preferred hand upper limit is 9½. Other rules similar to Blackjack rules and result in payoffs from ½ the core wager up to three times the core wager in increments of ½.

These and other objects and advantages of the invention are achieved by providing a method of playing a card game including the steps of (a) receiving a core wager from a player; (b) dealing hands of cards to a player and a dealer; (c) establishing numerical card values, wherein aces count as 1, cards numbered 2–9 count as face value, cards numbered 10 count either as 0 or ½, and picture cards count as ½; (d) determining an outcome of the card game according to rules of the card game based on the established numerical card values; and (e) if the player wins the card game according to the rules of the card game, paying the player a payoff based on the core wager determined by a numerical difference between the player's hand and the dealer's hand.

Step (b) may be practiced by dealing one- or two-card hands of cards to the player and the dealer. In this context, step (c) is preferably practiced by (c1) the player determining a numerical total of the player's hand; (c2) the player effecting one or more game options according to the rules of the game, such as standing, hitting, splitting cards and/or doubling the core wager; (c3) the dealer determining a numerical total of the dealer's hand, wherein (c3-i) if the dealer hand numerical total is below a lower limit, the dealer drawing another card and repeating step (c3), (c3-ii) if the dealer hand numerical total is equal to or higher than the lower limit and equal to or less than an upper limit, the dealer standing and proceeding to step (c4), (c3-iii) if the dealer hand numerical total is higher than the upper limit and the player hand numerical total is equal to or lower than the upper limit, the dealer proceeding to step (c4); and (c4) the dealer resolving the player's wager according to the rules of the game. Still further, step (c4) may be practiced by declaring the wager a push if the player hand numerical total is equal to the dealer hand numerical total, declaring the wager a push if the dealer hand numerical total is higher than the upper limit and the player hand numerical total is lower than or equal to the upper limit, and if the player hand numerical total is lower than or equal to the upper limit and the dealer hand numerical total is lower than the upper limit, (i) paying the player a variable payoff based on the wager according to the numerical difference between the player's hand and the dealer's hand if the player hand numerical total exceeds the dealer hand numerical total, and (ii) the player forfeiting the wager if the dealer hand numerical total exceeds the player hand numerical total.

Preferably, the variable payoff is determined by reference to the following schedule:

| Player wins by: | Payoff |
|---|---|
| 3 ½ | 3 ½ to 1 |
| 3 | 3 to 1 |
| 2 ½ | 2 ½ to 1 |
| 2 | 2 to 1 |
| 1 ½ | 1 ½ to 1 |
| 1 | 1 to 1 |
| ½ | ½ to 1 |

The upper limit is preferably 9½, and the lower limit is any one of 6, 6½ or 7.

In accordance with another aspect of the invention, there is provided a method of playing a casino card game that is based on card hand numerical totals and includes a player core wager. The method includes paying a variable payoff according to the player core wager based on a difference between a dealer hand numerical total and a player hand numerical total, the dealer hand numerical total and the player hand numerical total being determined according to established numerical card values as noted above.

Generally, the variable payoff is preferably determined such that if a player wins by n, the payoff is n to 1.

In accordance with still another aspect of the invention, there is provided an apparatus configured for playing a card game according to the method of the invention.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

In the following detailed description, the method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, with the players simply keeping track of wins and losses.

Figure 1:
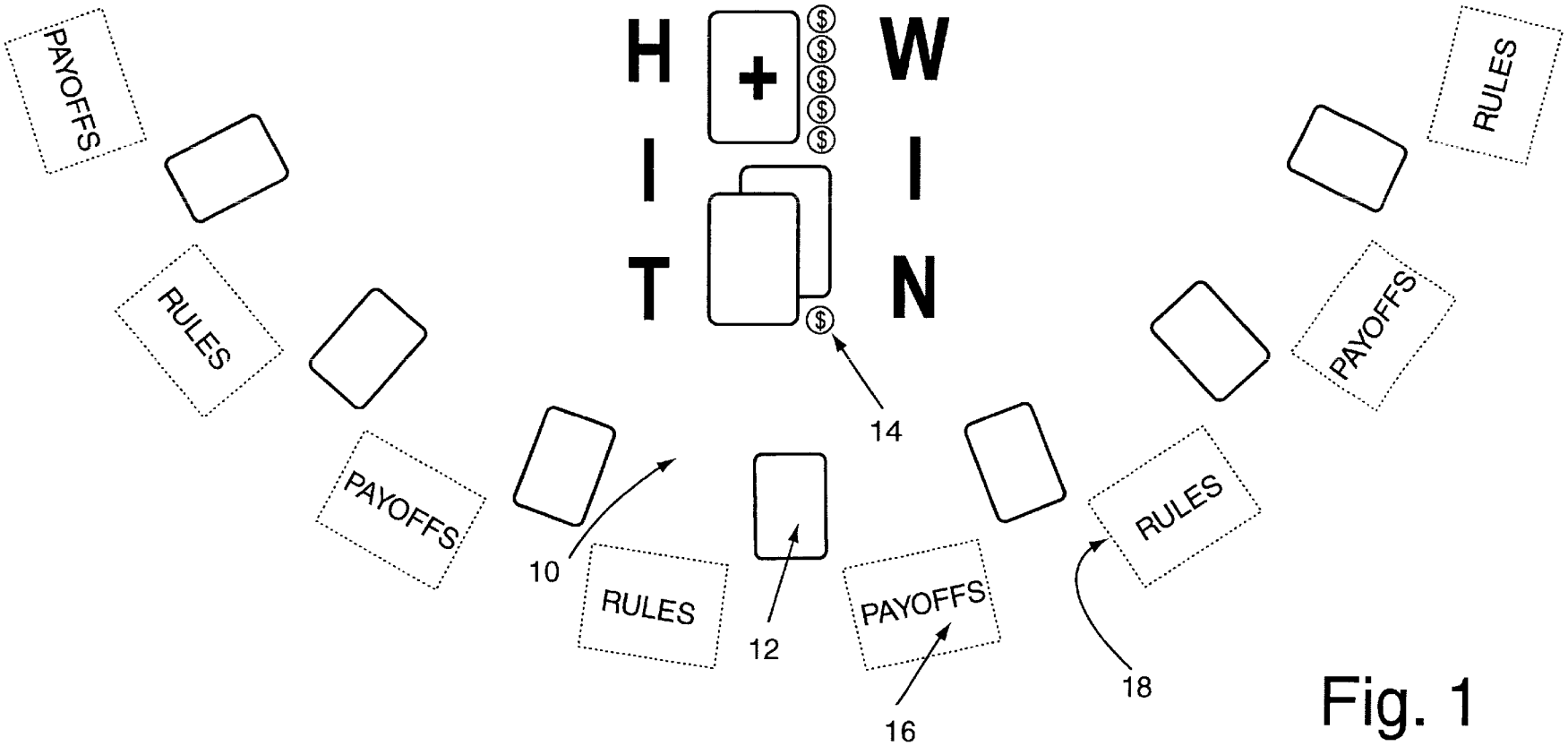
FIG. 1 is a plan view of a table arrangement according to the present invention.

In preferred forms, referring to FIG. 1, the card game according to the invention is played on a Blackjack shaped table with dealer and cards similar to a conventional Blackjack game. The table is specifically marked with regular Blackjack bet areas with also payoff information and promotional material as in FIG. 1. FIG. 1 shows a playing surface or table layout 10 on which an embodiment of the invention may be played. The layout provides a betting area 12 for each of a plurality of players, for example, seven players. A dealer area 14 is marked with payoff scales 16 and game rules 18.

As with conventional Blackjack, the number of card decks used for the game according to the invention may be one or more. Each player places a core wager in a respective betting area 12 in order to participate in the game. In the context of the present invention, the core wager is the only wager required for a player to participate in the game. The core wager can of course be supplemented in accordance with the rules of a particular game. For example, in Blackjack, the core wager can be doubled according to casino doubling rules, or when a player elects to split a pair into separate hands, it is typical for the player to match the original wager with a second wager of equal value for the second hand. Re-splitting of pairs may also be allowed as well as doubling after splitting, etc. As is conventional in Blackjack, doubling and splitting are effected only at the player's discretion and are never required, although often highly desirable to reduce house advantage. Regardless of the manner in which the wager is processed during the game, it is an important feature of the game that only a core wager is required for a player to completely participate in the game.

After wagers are placed, each participating player receives two cards in rotation with the dealer receiving a card face up and usually another card face down. The players in turn then elect how to play their respective hands according to the game rules 18. After all player actions are completed, the dealer's hand is played in the area 14 according to the game rules 18, and all wagers are settled according to the payoff scale 16. In preferred forms, if the player wins the card game according to the rules, the player is paid a payoff based on the core wager and determined by a numerical difference between the player's hand and the dealer's hand.

In a preferred embodiment, after two-card Blackjack hands of cards are dealt to each player and the dealer, the player, after determining a numerical sum of the player's hand card values, effects one or more game options according to the rules of Blackjack, as commonly approved by gaming regulatory authorities. Exemplary game options for the player include hitting or drawing, standing, splitting pairs (and allowing re-splitting of pairs), doubling down, hitting or doubling after a previous double or split, and the like as desired. In executing particular game options, if the numerical total of the player's hand exceeds an upper limit, such as 21, the player "busts" and thereby forfeits the wager associated with that hand. If the player has completed exercising game options and the numerical total of the player's hand is equal to or less than the upper limit, the game then proceeds to each player in turn.

Provided all players have not busted, i.e., there is at least one player remaining in the game, the dealer then determines a numerical total of the dealer's hand. If the dealer hand numerical total is below a lower limit, such as 16, 17 or 18, and preferably 17, the dealer draws another card and re-determines the numerical total of the hand. If the dealer hand numerical total is equal to or higher than the lower limit and equal to or less than the upper limit, the dealer stands, and the game proceeds to resolve remaining player's wagers according to the rules of the game. Finally, if the dealer hand numerical total exceeds the upper limit, the dealer then resolves the player's wager according to the rules of the game. In this instance, in the preferred embodiment, when the dealer "busts" the wager is declared a "push" (tie), and the player's wager is returned. Similarly, the wager is declared a push if the player hand numerical total is equal to the dealer hand numerical total. If the player hand numerical total is lower than or equal to the upper limit and the dealer hand numerical total is lower than the upper limit, (i) the player is paid a variable payoff based on the core wager according to the numerical difference between the player's hand and the dealer's hand if the player hand numerical total exceeds the dealer hand numerical total, and (ii) the player forfeits the wager if the dealer hand numerical total exceeds the player hand numerical total.

The variable payoff is preferably determined according to the following schedule, including possible hands based on an upper limit of 21 and a lower limit (i.e., dealer standing total) of 17.

| Player wins by: | Payoff | Player | Dealer |
|---|---|---|---|
| 4 | 4 to 1 | 21 | 17 |
| 3 | 3 to 1 | 21 | 18 |
| | | 20 | 17 |
| 2 | 2 to 1 | 21 | 19 |
| | | 20 | 18 |
| | | 19 | 17 |
| 1 | 1 to 1 | 21 | 20 |
| | | 20 | 19 |
| | | 19 | 18 |
| | | 18 | 17. |

Generally in this preferred context, if a player wins by n, the payoff is n to 1.

To encourage players to play the correct strategy, certain ties may be designated as player wins. For example, a tie on 17 could result in a payoff of 1 to 1. Also, to enable variation in house advantage, certain hands could be given a favorable return. For example, a player two card total of 21 could be paid 5 to 1 when the dealer total is 17. Further, a player two card total of 21 could be paid 1 to 1 when the dealer has a total of 21 irrespective of the number of dealer cards, whereas a player total of 21 with three or more cards could be settled as a push with a dealer total of 21 irrespective of the number of dealer cards.

Thus, according to the present invention, a variable payoff is paid according to the player core wager based on a difference between the dealer hand numerical total and the player hand numerical total. As noted above, this methodology effects greater enjoyment for players with the possibility of higher payoffs than in conventional Blackjack and also enables novice and inexperienced players to play correctly and better enjoy the game.

Although described in the context of a Blackjack derivative, the principles according to the present invention wherein a variable payoff is paid based on a difference between a dealer hand numerical total and a player hand numerical total, can be applied to Baccarat, War, and other conventional casino games wherein the numerical total of card hands affects the outcome of the game.

In an alternative embodiment, the card game is provided with a modified card numerical value system. In one version, aces count as 1, cards numbered 2–9 count as face value, and cards numbered 10 and picture cards count as ½. In another version, aces count as 1, cards numbered 2–9 count as face value, cards numbered 10 count as 0 and picture cards count as ½. The game is played in the style of Blackjack with a maximum hand (upper limit) of 9½. In game play, after receiving a core wager from the players, all players receive a card face up, and the dealer may then receive a card face down, face up or only after all player hands are completed. The players can draw (hit) until attaining a numerical total of 9½, and as in the Blackjack variation, if the player hand numerical total exceeds 9½, the player busts. Splitting cards and/or doubling down as discussed above may or may not be permitted according to casino preference. In this context, a unique feature would be to allow a single split of a pair when that pair would normally be a bust hand. In the case of a pair of 99 88 77 66 55, these total over 9 and ½. Allowing a split provides extra player opportunity to participate.

After all player hands are completed, the dealer hand is played according to predefined casino rules. That is, the dealer must stand on a numerical hand total of 6, 6½ or 7, depending on casino preference and desired house advantage. The player core wagers are then resolved preferably similarly to the first embodiment discussed above, wherein if a player wins by n, the payoff is n to 1. In the present operating mode, the core wagers may thus be resolved according to the following:

| Win by | Pays |
|---|---|
| 3 ½ | 3 ½ to 1 |
| 3 | 3 to 1 |
| 2 ½ | 2 ½ to 1 |
| 2 | 2 to 1 |
| 1 ½ | 1 ½ to 1 |
| 1 | 1 to 1 |
| ½ | ½ to 1 |

In the event of dealer bust, similar to the above-described embodiment, the wagers are pushed. Ties can be resolved in numerous ways according to casino preference, including pushing ties, taking wagers in the event of ties, or paying a fixed payout such as 1 to 1 in the event of a tie.

As would be apparent to those skilled in the relevant art, the invention can be embodied in a wide variety and forms of media, but not limited to, single player slot video machines, multi-player slot video machines, electronic games and devices, lottery terminals, scratch-card formats, software as well as in-flight, home and Internet entertainment. In addition, the invention can be readily implemented as a computer program product (e.g., floppy disk, compact disc (CD), etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
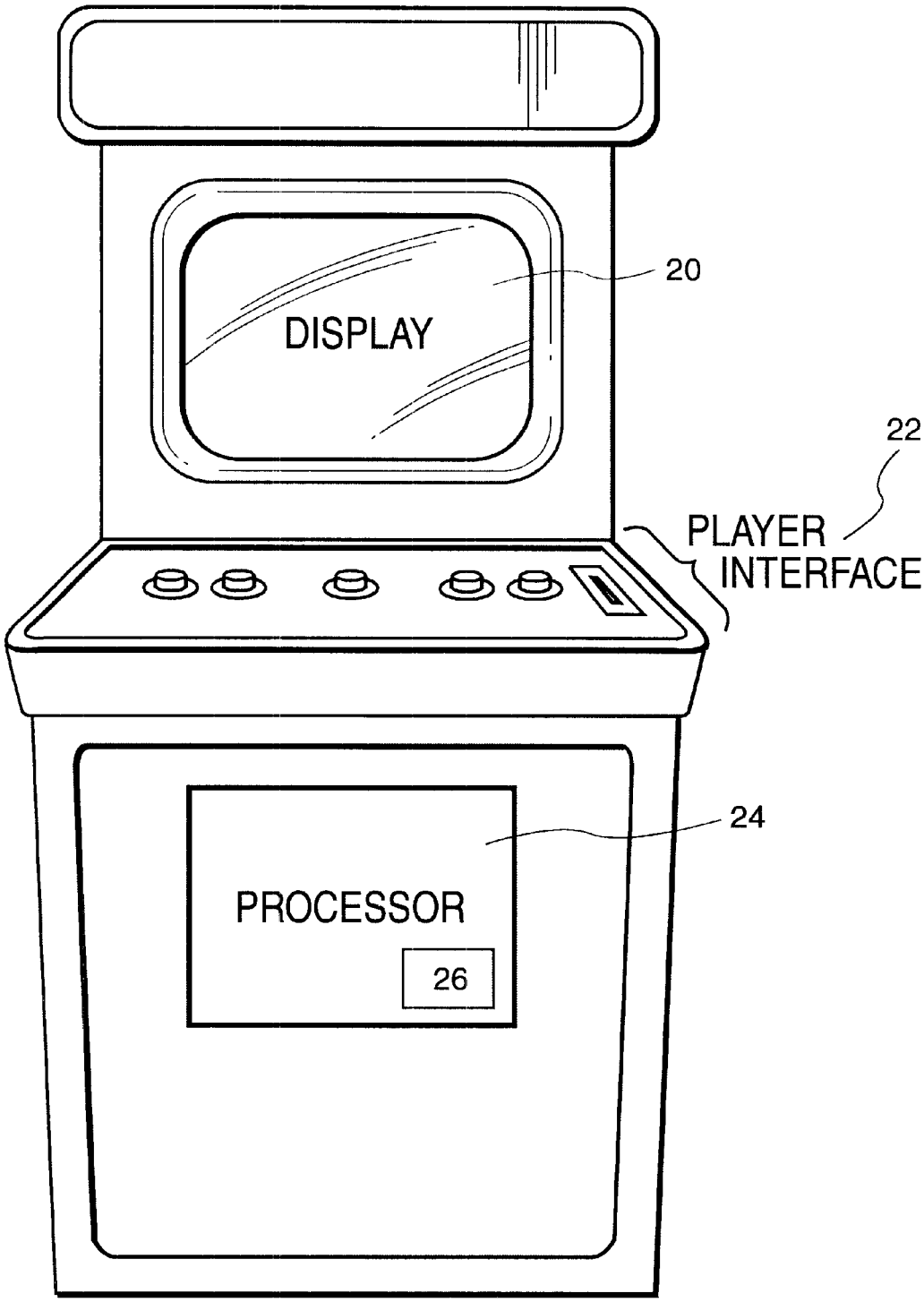
FIG. 2 is a schematic diagram illustrating the structure effecting game play according to the apparatus of the present invention.

In this context, referring to FIG. 2, a schematic diagram is illustrated showing the components of an apparatus configured for playing the card game according to the invention. The apparatus includes a display 20, a player interface 22, and circuitry 24, 26 for effecting game play and including structure for receiving a core wager from a player and dealing hands of cards to a player and to a dealer. A processing circuit 24 includes a summing circuit 26 that determines numerical totals of the player's and dealer's hands. The player interface 22 enables the player to exercise game options according to the rules of the game, and the processing circuit 24 effects game play in accordance with the rules of the game. In the exemplary Blackjack derivative embodiment described, after the player has completed exercising game options, the processing circuit 24 effects game play such that:

(i) if the dealer hand numerical total is below a lower limit, the dealer draws another card and the summing circuit re-determines the numerical total of the dealer's hand until the dealer's hand is equal to or higher than the lower limit, (ii) if the dealer hand numerical total is equal to or higher than the lower limit and equal to or less than an upper limit, the dealer stands, and (iii) if the dealer hand numerical total is higher than the upper limit and the player hand numerical total is equal to or lower than the upper limit, the processing circuit effects resolution of the player's core wager according to the rules of the game.

The processing circuit 24 declares the wager a push if the player hand numerical total is equal to the dealer hand numerical total, declares the wager a push if the dealer hand numerical total is higher than the upper limit and the player hand numerical total is lower than or equal to the upper limit, and if the player hand numerical total is lower than or equal to the upper limit and the dealer hand numerical total is lower than the upper limit, (i) pays the player a variable payoff based on the wager according to the numerical difference between the player's hand and the dealer's hand if the player hand numerical total exceeds the dealer hand numerical total, and (ii) the player forfeits the wager if the dealer hand numerical total exceeds the player hand numerical total.

According to the invention, a casino game variant is disclosed that obviates many problems associated with conventional games while improving playability and overall player enjoyment. By providing a variable payoff scale based on a difference between numerical totals of a dealer's hand and a player's hand, the dynamics of the conventional game are altered to provide a more exciting and enjoyable casino card game.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a card game comprising:

(a) receiving a core wager from a player, the core wager being the only wager required for the player to participate in the game;

(b) dealing hands of at least one card to a player and a dealer;

(c) establishing numerical card values, wherein aces count as 1, cards numbered 2–9 count as face value, cards numbered 10 count either as 0 or ½, and picture cards count as ½;

(d) determining an outcome of the card game according to rules of the card game based on the established numerical card values; and (e) if the player wins the card game according to the rules of the card game, paying the player a payoff based on the core wager determined by a numerical difference between the player's hand and the dealer's hand.

2. A method according to claim 1, wherein step (b) is practiced by dealing one-card hands of cards to the player and the dealer.

3. A method according to claim 2, wherein the variable payoff is determined according to the following schedule:

| Player wins by: | Payoff |
|---|---|
| 3 ½ | 3 ½ to 1 |
| 3 | 3 to 1 |
| 2 ½ | 2 ½ to 1 |
| 2 | 2 to 1 |
| 1 ½ | 1 ½ to 1 |
| 1 | 1 to 1 |
| ½ | ½ to 1. |

4. A method according to claim 2, wherein step (c) is practiced by:

(c1) the player determining a numerical total of the player's hand;

(c2) the player effecting one or more game options according to the rules of the game;

(c3) the dealer determining a numerical total of the dealer's hand, wherein:

(c3-i) if the dealer hand numerical total is below a lower limit, the dealer drawing another card and repeating step (c3), (c3-ii) if the dealer hand numerical total is equal to or higher than the lower limit and equal to or less than an upper limit, the dealer standing and proceeding to step (c4), (c3-iii) if the dealer hand numerical total is higher than the upper limit and the player hand numerical total is equal to or lower than the upper limit, the dealer proceeding to step (c4); and (c4) the dealer resolving the player's wager according to the rules of the game.

5. A method according to claim 4, wherein step (c2) is practiced by splitting cards or doubling the core wager according to the game rules.

6. A method according to claim 4, wherein if the player hand numerical total is equal to the dealer hand numerical total, step (c4) is practiced by declaring the wager a push.

7. A method according to claim 4, wherein step (c4) is practiced by declaring the wager a push if the player hand numerical total is equal to the dealer hand numerical total, declaring the wager a push if the dealer hand numerical total is higher than the upper limit and the player hand numerical total is lower than or equal to the upper limit, and if the player hand numerical total is lower than or equal to the upper limit and the dealer hand numerical total is lower than the upper limit, (i) paying the player a variable payoff based on the wager according to the numerical difference between the player's hand and the dealer's hand if the player hand numerical total exceeds the dealer hand numerical total, and (ii) the player forfeiting the wager if the dealer hand numerical total exceeds the player hand numerical total.

8. A method according to claim 7, wherein the variable payoff is determined according to the following schedule:

| Player wins by: | Payoff |
|---|---|
| 3 ½ | 3 ½ to 1 |
| 3 | 3 to 1 |
| 2 ½ | 2 ½ to 1 |
| 2 | 2 to 1 |
| 1 ½ | 1 ½ to 1 |
| 1 | 1 to 1 |
| ½ | ½ to 1. |

9. A method according to claim 4, wherein the upper limit is 9½, and wherein the lower limit is one of 6, 6½ or 7.

10. A method according to claim 9, wherein the lower limit is 6.

11. A method according to claim 9, wherein the lower limit is 6½.

12. A method according to claim 9, wherein the lower limit is 7.

13. A method of playing a casino card game that is based on card hand numerical totals and includes a player core wager, the core wager being the only wager required for the player to participate in the game, the method comprising paying a variable payoff according to the player core wager based on a difference between a dealer hand numerical total and a player hand numerical total, the dealer hand numerical total and the player hand numerical total being determined according to established numerical card values, wherein aces count as 1, cards numbered 2–9 count as face value, cards numbered 10 count either as 0 or ½, and picture cards count as ½.

14. A method according to claim 13, wherein the variable payoff is determined according to the following schedule:

| Player wins by: | Payoff |
|---|---|
| 3 ½ | 3 ½ to 1 |
| 3 | 3 to 1 |
| 2 ½ | 2 ½ to 1 |
| 2 | 2 to 1 |
| 1 ½ | 1 ½ to 1 |
| 1 | 1 to 1 |
| ½ | ½ to 1. |

15. A method according to claim 14, wherein the variable payoff is determined such that if a player wins by n, the payoff is n to 1.

16. An apparatus for playing a card game comprising:

means for receiving a core wager from a player, the core wager being the only wager required for the player to participate in the game;

means for dealing hands of cards to a player and a dealer;

means for establishing numerical card values, wherein aces count as 1, cards numbered 2–9 count as face value, cards numbered 10 count either as 0 or ½, and picture cards count as ½;

means for determining an outcome of the card game according to rules of the card game based on the established numerical card values; and if the player wins the card game according to the rules of the card game, means for paying the player a payoff based on the core wager determined by a numerical difference between the player's hand and the dealer's hand.

17. An apparatus for playing a card game that is based on card hand numerical totals and includes a core wager, the core wager being the only wager required for the player to participate in the game, the apparatus comprising means for paying a variable payoff according to the player core wager based on a difference between a dealer hand numerical total and a player hand numerical total, the dealer hand numerical total and the player hand numerical total being determined according to established numerical card values, wherein aces count as 1, cards numbered 2–9 count as face value, cards numbered 10 count either as 0 or ½, and picture cards count as ½.

* * * * *